US007334366B2

(12) United States Patent
La France

(10) Patent No.: US 7,334,366 B2
(45) Date of Patent: Feb. 26, 2008

(54) ACCESSORY MOUNT FOR A FIREARM

(75) Inventor: Timothy F. La France, Newport Beach, CA (US)

(73) Assignee: Surefire, LLC, Fountain Valley, CA (US)

( * ) Notice: Subject to any disclaimer, the term of this patent is extended or adjusted under 35 U.S.C. 154(b) by 201 days.

(21) Appl. No.: 11/244,632

(22) Filed: Oct. 5, 2005

(65) Prior Publication Data

US 2007/0074443 A1 Apr. 5, 2007

(51) Int. Cl.
*F41G 1/35* (2006.01)

(52) U.S. Cl. ..... 42/146; 42/115

(58) Field of Classification Search ..... 42/146, 42/114, 115, 116, 117, 142
See application file for complete search history.

(56) References Cited

U.S. PATENT DOCUMENTS

| | | | | |
|---|---|---|---|---|
| 1,338,239 | A | 4/1920 | Matys | |
| 2,450,584 | A | 10/1948 | Dodge | |
| 3,584,533 | A | 6/1971 | Allyn | |
| 3,657,959 | A | 4/1972 | Kart | |
| 3,901,125 | A | 8/1975 | Raville | |
| 4,127,056 | A | 11/1978 | Kart | |
| 4,313,272 | A | 2/1982 | Matthews | |
| 4,344,246 | A | 8/1982 | Bauman et al. | |
| 4,418,487 | A | 12/1983 | Strahan | |
| 4,542,447 | A | 9/1985 | Quakenbush | |
| 4,777,754 | A | 10/1988 | Reynolds, Jr. | |
| 4,856,218 | A | 8/1989 | Reynolds, Jr. | |
| 5,107,612 | A | 4/1992 | Bechtel | |
| 5,208,826 | A | 5/1993 | Kelly | |
| 5,299,375 | A | 4/1994 | Thummel et al. | |
| 5,323,555 | A | 6/1994 | Jehn | |
| 5,388,364 | A | 2/1995 | Paldino | |
| 5,430,967 | A | 7/1995 | Woodman, III et al. | |
| 5,457,901 | A | 10/1995 | Gernstein et al. | |
| 5,471,777 | A | 12/1995 | McDonald | |
| 5,522,167 | A | 6/1996 | Teetzel | |
| 5,581,898 | A | 12/1996 | Thummel | |
| 5,584,137 | A | 12/1996 | Teetzel | |
| 5,621,999 | A | 4/1997 | Moore | |
| 5,628,555 | A | 5/1997 | Sharrah et al. | |
| 5,654,594 | A | 8/1997 | Bjornsen, III et al. | 42/71.01 |
| 5,669,174 | A | 9/1997 | Teetzel | 89/41.06 |
| 5,758,448 | A | 6/1998 | Thummel | |
| 5,768,819 | A | 6/1998 | Neal | 42/70.07 |
| 5,816,683 | A | 10/1998 | Christiansen | |
| 5,930,935 | A | 8/1999 | Griffin | 42/77 |
| 6,023,875 | A | 2/2000 | Fell et al. | |
| 6,378,237 | B1 * | 4/2002 | Matthews et al. | 42/124 |
| 6,393,752 | B1 * | 5/2002 | Oliver et al. | 42/114 |
| 6,591,536 | B2 | 7/2003 | Houde-Walter et al. | 42/114 |
| 6,705,038 | B2 | 3/2004 | Davenport et al. | 42/148 |
| 7,076,908 | B2 * | 7/2006 | Kim | 42/146 |
| 2005/0115142 | A1 | 6/2005 | Kim | |

* cited by examiner

*Primary Examiner*—Stephen M Johnson
(74) *Attorney, Agent, or Firm*—David Weiss

(57) ABSTRACT

An accessory mount having a rail for removably mounting an accessory (such as a light beam generator) to a firearm, the accessory mount being removably secured to the firearm through utilization of a transverse pin retained by the firearm, and positionally stabilized by utilization of a wedge shaped member urged between the mount and the firearm's trigger guard.

19 Claims, 4 Drawing Sheets

ACCESSORY MOUNT FOR A FIREARM

BACKGROUND OF THE INVENTION

This invention relates to accessory mounts for mounting an accessory to a firearm, and more particularly to a mount or interface adapter for securing a light beam generator apparatus to a firearm including a handgun.

Light beam generator apparatus, such as flashlights and laser aiming devices, have long been adapted for being secured to firearms as target illuminators and laser sights. For example, U.S. Pat. No. 4,777,754, issued to Edward C. Reynolds, Jr. and assigned to the assignee of the present invention, teaches a light beam generator assembly mounted to a firearm below the firearm's barrel and forwardly of the firearm's trigger guard. As applied to a handgun having a longitudinally moveable slide and a slide stop which causes the slide to lock open automatically after the last round has been fired and ejected, or which may be manually actuated at other times, the Reynolds light beam generating apparatus is pivotably secured to the handgun's slide stop pin transversely secured to the handgun frame. Positional stabilization of the secured light beam generator device on the handgun is facilitated by an adjustable set screw extending from the rear of the light beam generator housing and abutting the front surface of the handgun's trigger guard. Reynolds U.S. Pat. No. 4,777,754 is incorporated herein by reference.

U.S. Pat. No. 6,378,237, issued to John W. Matthews and Paul Y. Kim and assigned to the assignee of the present invention, discloses an accessory mount or interface adapter clamped to the front of the handgun's trigger guard and longitudinally extending beneath the handgun's barrel. The accessory mount includes a rail having a pair of longitudinal grooves, one along each side of the rail, and the light beam generator apparatus includes a pair of longitudinal tongues for slidably mating with the mount's longitudinal grooves for being slidably held along the rail. A latch on the light beam generator housing co-acts with a transverse slot in the rail to releasably prevent further longitudinal movement of the light beam generator apparatus when such apparatus is at a predetermined position along the rail. Matthews et al. U.S. Pat. No. 6,378,237 is incorporated herein by reference.

U.S. patent application Ser. No. 10/889,768, by Paul Y. Kim and assigned to the assignee of the present invention, published as U.S. Patent Application Publication No. US-2005-0115142-A1, discloses an accessory mount or interface adapter for mounting a rail mountable accessory (such as a light beam generator apparatus) to a firearm, which accessory mount is removably secured to the firearm through utilization of an improved slide stop and pin combination, and which accessory mount is positionally stabilized by utilization of a shock absorbing trigger guard bumper. In the preferred embodiment disclosed therein, a rearwardly spring-biased resilient bumper is carried by the accessory mount and rearwardly urged against the trigger guard. U.S. Patent Application Publication No. U.S.-2005-0115142-A1 is incorporated herein by reference.

SUMMARY OF THE INVENTION

By the present invention, there is provided an accessory mount or interface adapter having a rail for mounting a rail mountable accessory (in particular a light beam generator apparatus) to a firearm, which accessory mount is removably secured to the firearm through utilization of a transverse pin retained by the firearm, and which accessory mount is positionally stabilized by utilization of a preferably elastomeric generally wedge shaped member urged between the mount and the firearm's trigger guard.

According to a preferred embodiment of the present invention, there is provided an accessory mount for mounting an accessory device to a firearm, the firearm including a longitudinal barrel, a frame having a transverse bore and a trigger guard, the accessory device comprising the combination of: a longitudinal rail adapted for removably securing the accessory device thereto; structural members upwardly projecting from the respective sides of the rail and adapted to straddle the frame with the rail beneath the barrel and forwardly of the trigger guard, the structural members including respective bores situated for being transversely aligned with the bore in the frame when the accessory mount is applied to the frame; a pin configured for being received by the bores in the longitudinal members and the bore in the frame when the accessory mount is applied to the firearm; an appendage downwardly projecting from the rail in the vicinity of the rear end of the rail; and a generally wedge shaped member, preferably elastomeric and carried by the appendage, for being wedged between the appendage and the trigger guard when the accessory mount is applied to the firearm with the pin received by the bores in the structural members and the bore in the frame.

The preferred embodiment of the present invention is of particular application with a handgun including a slide and a slide stop, wherein the pin is secured to the slide stop for pivotally securing the slide stop to the frame of the firearm. The slide stop is preferably pivotable about the pin, such as by being rotatably secured to the pin.

In the accessory mount of the preferred embodiment, the appendage includes a front wall depending from the rail and having a rear surface engaging a first wedging face of the elastomeric generally wedge shaped member. The generally wedge shaped member includes a second wedging face engaging a front surface of the trigger guard when the generally wedge shaped member is wedged between the appendage and the trigger guard. The generally wedge shaped member includes a base, and the appendage includes a threaded bore and a set screw threadedly engaging the threaded bore for cooperating with the base for urging the generally wedge shaped member to be wedged between the rear surface of the appendage front wall and the front surface of the trigger guard.

In the preferred embodiment where the generally wedge shaped member is elastomeric, the generally wedge shape member includes a rigid plate on the base for being contacted by the set screw.

According to another aspect of the present invention, there is provided apparatus for a firearm including a longitudinal barrel, a frame having a transverse bore, and a slide longitudinally movable along the frame, such apparatus comprising: a pin configured for being received by the transverse bore, the pin including a head and an annular protrusion spaced from the head; and a slide stop rotationally secured to the pin between the head and the protrusion. In a preferred embodiment, the pin includes an annular groove spaced from the head; and the protrusion comprises a ring retained by the groove and peripherally protruding therefrom.

BRIEF DESCRIPTION OF THE DRAWINGS

The novel features believed to be characteristic of the present invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
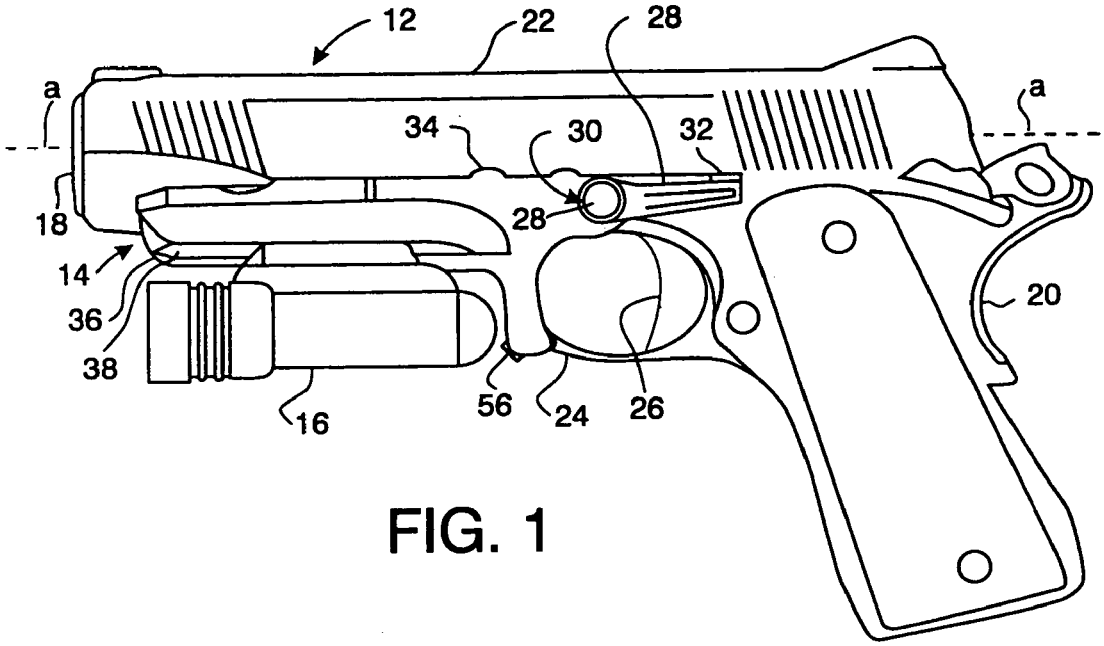
FIG. 1 is a side elevation view of a firearm with a light beam generator apparatus mounted to a preferred embodiment of an accessory mount or interface adapter according to the present invention, the accessory mount being secured to the firearm.
Figure 2:
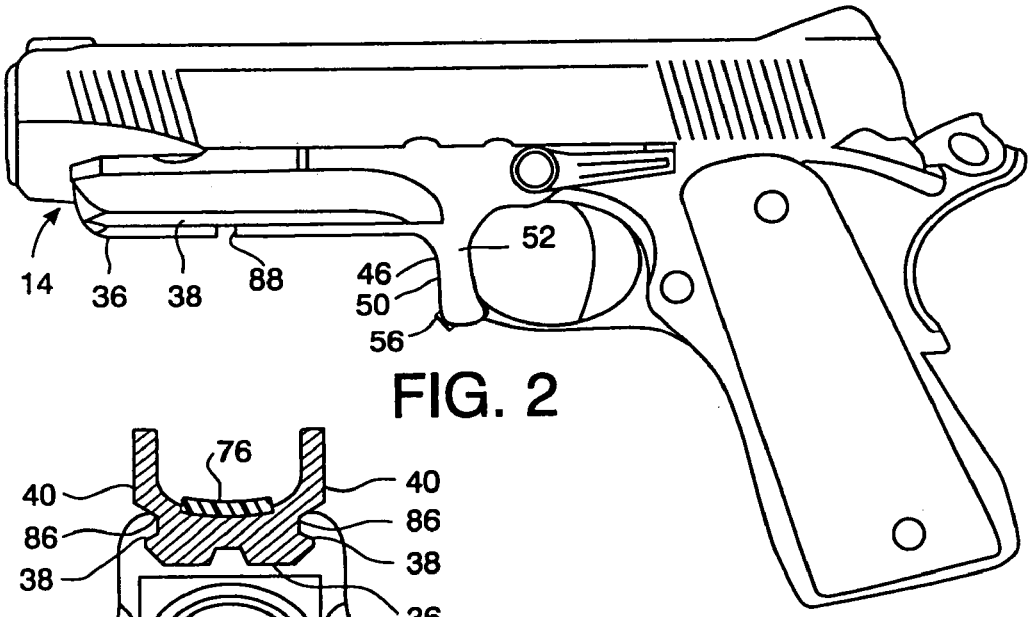
FIG. 2 is similar to FIG. 1, except that the light beam generator apparatus has been removed therefrom.

Turning to the drawings, there is illustrated in FIGS. 1 and 2 an example of a firearm 12, specifically a 0.45 caliber Model 1911 handgun, to which a preferred embodiment of an accessory mount or interface adapter 14 according to the present invention has been secured, FIG. 1 also showing a light beam generator apparatus or light module 16 mounted to the accessory mount 14. The firearm 12 includes a barrel 18 extending along a longitudinal axis a from the handgun's frame 20, and includes a slide 22 which houses the handgun's firing pin, firing pin block and extractor, and which cocks the hammer during recoil. The handgun 12 includes a trigger guard 24 in front of the handgun's trigger 26.

As used herein, the word "longitudinal" describes a direction along or parallel to the axis a; "transverse" describes a horizontal direction perpendicular to the axis a when the barrel 18 is horizontally positioned; "above" means vertically above when the handgun 12 is held with its barrel 18 horizontal; "below" or "beneath" means vertically below when the handgun 12 is held with the barrel 18 horizontal; "front" or "forward" describes the direction toward the muzzle of the barrel 18 (i.e., to the left as shown in FIGS. 1-3, 6 and 12); and "rear" or "rearward" describes the direction opposite the front or forward direction (i.e., to the right as shown in the drawing of FIGS. 1-3, 6 and 12). The words "resilient" and "elastomeric" are used interchangeably.

As is well known in handguns of this type, upon firing of the handgun the slide moves rearwardly with respect to the frame, extracting the fired cartridge case for ejection by the ejector, cocks the hammer and compresses the recoil spring, after which the slide moves forwardly feeding the next cartridge into the chamber and locking the breech. After the last round has been fired and ejected, a slide stop 28 is rotatably urged by the magazine follower to pivot about the axis of a transverse pin 30 supported by the frame 20, such that a projection 32—slidably retained along a longitudinal edge of the slide 22—of the slide stop 28 (see also FIG. 14) is upwardly urged to engage a recess 34 along such edge of the slide 22, for releasably stopping and holding the slide 22 in its rearward or open position.

The accessory mount 14 includes a longitudinal rail 36 (parallel to longitudinal axis a' which is beneath and parallel to the axis a when the accessory mount 14 is installed on the handgun 12) having two longitudinal grooves 38, one along each side of the rail 36. Two structural members or uprights 40 upwardly project from the rail 36 and longitudinally extend along the respective sides of the rail 36. Two transversely aligned bores 42 extend through the uprights 40 in the vicinity of the rear ends 44 of the structural members 40. An appendage 46 projects downwardly from the rail 36, and is preferably positioned toward the rear of the rail 36 and forwardly of the transverse bores 42.

The accessory mount 14 is dimensioned such that it may be placed to the handgun 12 with the structural members 40 straddling the handgun's frame 20 beneath the barrel 18, and with the appendage 46 just forward of the trigger guard 24 when the structural members'rear bores 42 are transversely aligned with a transverse bore 48 (FIG. 12) in the frame 20 through which the handgun's slide stop pin 30 extends. The accessory mount 14 is thereby pivotally secured to the handgun frame 20 about the transverse axis t of the installed slide stop pin 30.

In its preferred embodiment, the appendage 46 is generally U-shaped in cross-section, and includes a generally vertical front wall 50 depending from the rail 36, lateral walls for straddling a front section of the trigger guard 24 when the accessory mount 14 is installed to the handgun 12, and a lip 54 rearwardly projecting from the bottom edge of the front wall 50 but forwardly spaced from the trigger guard 24.

The appendage 46 further includes a set screw 56 threadedly retained by a threaded bore 58 through the appendage 46 generally along the intersection of the front wall 50 and the lip 54, preferably midway between the lateral walls 52. The threaded bore 58 is directed along an angle $\alpha$ with respect to the longitudinal axis a'. The inserted set screw therefore extends along the angle α as well; a preferred example of the angleα is approximately 45°.

A generally wedge shaped member 60 is, in the preferred embodiment, carried by the appendage 46, with a first face 62 of the wedge 60 engaging the rear surface 51 of the appendage front wall 50 and the opposing second face 64 of the wedge 60 contoured for engaging a front surface of the trigger guard 24. The wedge 60 is truncated so that its base 66 forms the angle α with the longitudinal axis a' when installed in the appendage 46, i.e. 45° in the preferred example.

The generally wedge shaped member 60 preferably comprises a resilient or elastomeric member having a rigid base portion. For example, the wedge 60 may be comprised of an elastomeric material (two examples of which are a polymeric elastomer and neoprene) to which a rigid plate 68 (such as a hardened steel plate) is retained on the base 66; in an example, a rectangular steel plate 68 may be fitted into a rectangular recess in the base 66, with circular protrusions 70 of the elastomeric material fitted within bores 72 through the plate 68 for retainably engaging the plate 68.

The generally wedge shaped member 60 is fitted to the appendage 46 with the substantially planar (in the preferred example) first face 62 of the wedge 60 preferably contacting the rear surface 51 of the appendage front wall 50, and with the wedge's vertical sides 74 contacting the inner surfaces of the appendage lateral walls 52. Further, the bottom edge 75 of the wedge 60 is placed upon the appendage lip 54 and the base 66 of the wedge 60 is rearwardly adjacent to the threaded bore 58, such that threading adjustment of the set screw 56 by a user will cause the tip of the set screw 56 to contact a central portion of the rigid plate 68 and urge the plate 68 along the angle α shown in FIG. 6, i.e. to be displaced upwardly and rearwardly along the angle α or generally along a 45° line of travel in the preferred example.

When securing the accessory mount 14 to the handgun 12, the slide stop pin originally supplied with the handgun 12 is removed from the frame bore 48. The accessory mount 14 is then applied to the handgun 12 with the bores 42 of the uprights 40 aligned with the frame transverse bore 48 and a slide stop pin inserted through the bores, with the rail 36 longitudinally extending beneath the barrel 18. A spacer 76, for example a pad of preferably resilient material such as neoprene, may be secured to the upper surface of the rail 36 for engaging the lower surface of the handgun frame 20, for spacing such frame surface from the upper surface of the rail 36 and for providing a cushion therebetween.

At this point during the installation process, the appendage 60 is positioned forwardly of the firearm's trigger guard 24 and with the appendage lateral walls 52 straddling a front section of the trigger guard 24. The contoured second face 64 of the wedge 60 is contacting a forward surface of the trigger guard 24, or is positioned slightly forwardly of the forward surface of the trigger guard 24. The user thereupon threadedly urges the set screw 56 along the angleα so that the head of the set screw 56 engages the rigid plate 68 and urges the rigid plate 68, and hence the base 66, upwardly and rearwardly along the angleα. Such urging of the plate 68 correspondingly urges the contoured second face 64 of the wedge against the front surface of the trigger guard 24, causing the wedge shaped member 62 to become wedged between the trigger guard 24 and the rear surface 51 of the appendage front wall 50, positionally stabilizing the accessory mount 14 with respect to the firearm 12.

Figure 13:
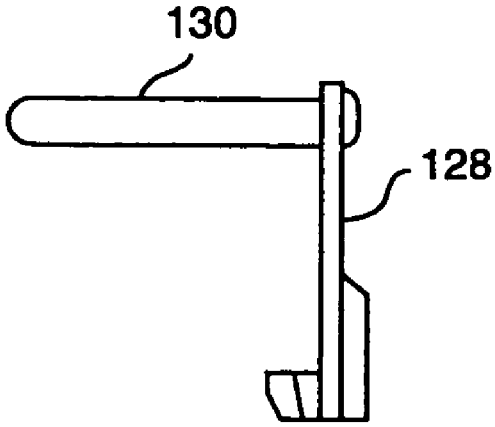
FIG. 13 (PRIOR ART)
FIG. 13 is a plan view of a prior art slide stop and pin combination for securing the accessory mount of the present invention to the handgun.

The accessory mount 14 of the present invention is preferably utilized in combination with a slide stop (preferably offset) and pin combination where the slide stop projection 32 is slidably retained along the edge of the slide 22. One prior art slide stop and pin combination is shown in FIG. 13, wherein the pin 130 is fixedly secured (such as by welding) to the slide stop 128. Although such welded slide stop and pin combinations may be utilized with the accessory mount 14 of the present invention, it is preferred that a slide stop and pin combination be utilized in which the slide stop is rotatably secured to the pin as taught in the aforementioned Paul Y. Kim Patent Application Publication No. U.S.-2005-0115142-A1, incorporated herein by reference. In the example disclosed in that Kim patent application publication, one end of the slide stop pin includes a neck portion inserted within a bore through the slide stop and retained by a retaining ring held by an outer groove in the pin's neck portion.

Figure 14:
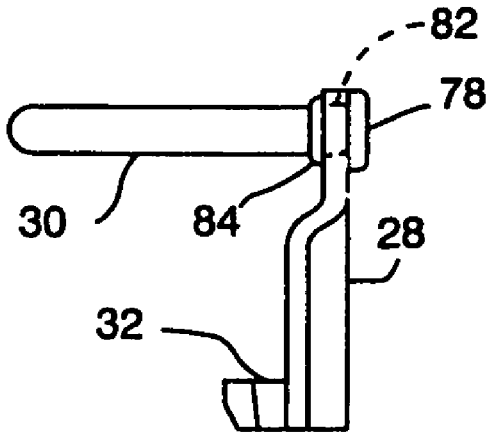
FIG. 14 is a plan view of a preferred embodiment of a modified slide stop and pin combination according to the present invention, for securing the accessory mount to the handgun.
Figure 15:
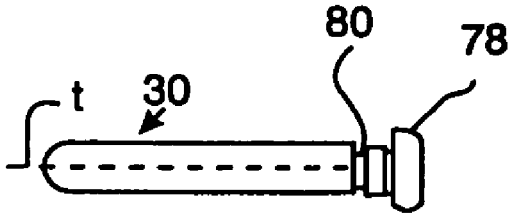
FIG. 15 is a plan view of the pin shown in FIG. 14.

Another example of a slide stop and pin combination where the slide stop is rotatably secured to the pin, which example comprises an aspect of the present invention, is shown in FIGS. 14 and 15. In the present example, the pin 30 includes a head 78 and an annular groove 80 spaced from the head 78. The pin 30 is inserted within a bore 82 in the slide stop 28, and the slide stop 28 is rotatably retained on the pin 30 between the head 78 and a peripherally protruding ring 84 retained by the annular groove. The resulting pivotal securement of the slide stop 28 about the pin 30 facilitates installation of the accessory mount to the handgun 12, by permitting free rotation of the slide stop 28 and consequent ease of positioning of the projection 32 to the slide 22 notwithstanding that the pin 30 may be forced against and held immobile by the surfaces of the bores 42 and/or 48.

The accessory mount body of the present invention may be made using fabrication methods well known in the art, of well-known materials typically used in the art of making firearm accessory mounts including rigid and durable materials such as polymeric materials as well as metals such as aluminum alloys.

Figure 4:
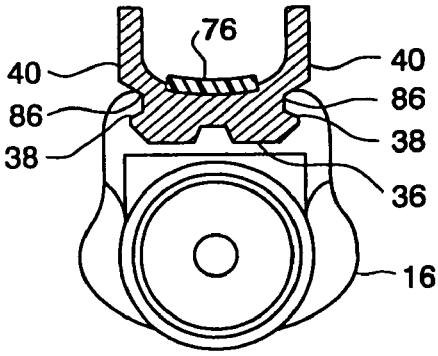
FIG. 4 is a cross-sectional view of the accessory mount shown in FIG. 1-3, taken along the line 4-4 of FIG. 3 and viewed in the direction of the appended arrows, FIG. 4 further including a front view representation of a light beam generator apparatus supportedly engaged by to the rail structure of the accessory mount as in FIG. 1.
Figure 3:
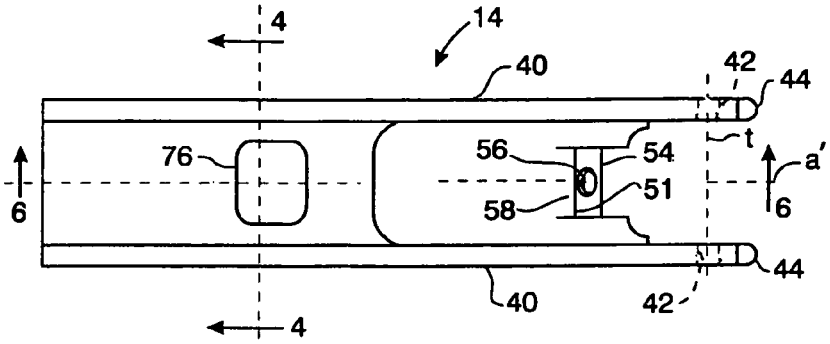
FIG. 3 is a top plan view of the accessory mount shown in FIGS. 1 and 2, in increased scale, but with the generally wedge shaped member removed for clarity of description.
Figure 6:
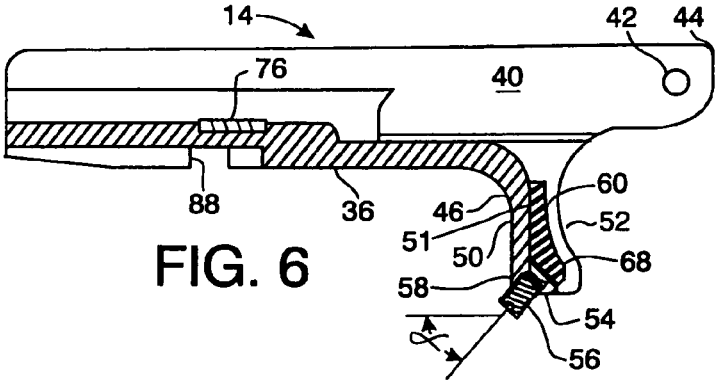
FIG. 6 is a cross-sectional view of the accessory mount of FIG. 5, taken along the line 6-6 of FIG. 3 and viewed in the direction of the appended arrows.
Figure 5:
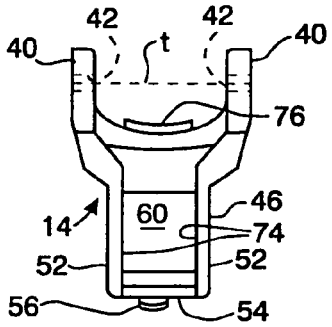
FIG. 5 is rear elevation view of the accessory mount shown in FIG. 3, with the generally wedge shaped member installed.
Figure 12:
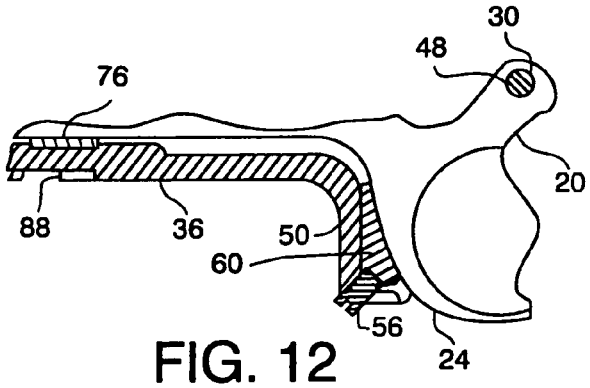
FIG. 12 is a fragmentary cross-sectional view of the accessory mount as in FIG. 6, shown installed on the frame of a handgun.
Figure 7:
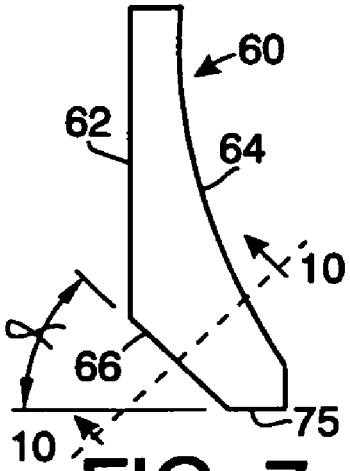
FIG. 7 is a side elevation view of a preferred embodiment of the generally wedge shaped member of the accessory mount of FIG. 5, shown in further increased scale.
Figure 8:
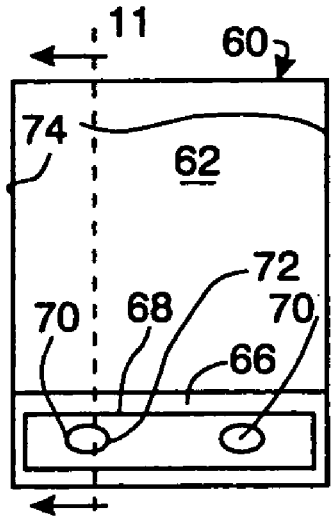
FIG. 8 is a rear elevation view of the generally wedge shaped member of FIG. 7.
Figure 9:
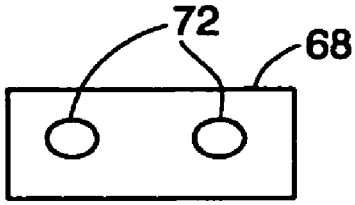
FIG. 9 is a view of the face of an example of a rigid plate included in the generally wedge shaped member shown in FIGS. 7 and 8.
Figure 11:
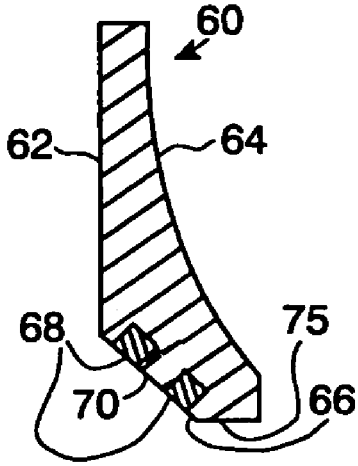
FIG. 11 is a cross-sectional view of the generally wedge shaped member of FIGS. 7 and 8, taken along the line 11-11 of FIG. 8 and viewed in the direction of the appended arrows.
Figure 10:
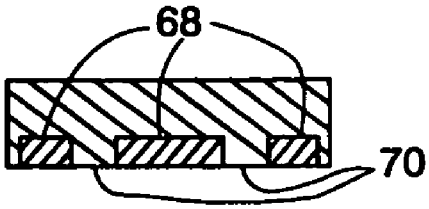
FIG. 10 is a cross-sectional view of the generally wedge shaped member shown in FIGS. 7 and 8, taken along the line 10-10 of FIG. 7 and viewed in the direction of the appended arrows.

After the accessory mount 14 has been installed on the handgun 12, an accessory such as a light beam generator apparatus may be mounted to the accessory mount 14. For example, as shown in FIGS. 1 and 4, the light module 16 includes a pair of longitudinal tongues 86 for slidably mating with the longitudinal grooves 38 of the accessory mount's rail 36. A latch on the light beam generator housing may co-act with a transverse slot 88 in the rail 36 for releasably preventing further longitudinal movement of the light beam generator 16 along the rail 36 when the light beam generator 16 is at a predetermined position along the rail 36. Light beam generators of this type are shown in the aforementioned U.S. Pat. No. 6,378,237 incorporated herein by reference.

Thus, there has been described a preferred embodiment of an accessory mount for removably mounting an accessory to a firearm. The accessory mount of the preferred embodiment is removably secured to the firearm through utilization of a slide stop and pin combination, preferably in which the slide stop is pivotally secured to the pin. The accessory mount preferred embodiment is positionally stabilized with respect to the firearm by means of a generally wedge shaped member, preferably elastomeric, urged between the mount and the firearm's trigger guard. Other embodiments of the present invention and of its various aspects, and variations of the embodiment and its aspects described herein, may be developed without departing from the essential characteristics thereof. Accordingly, the invention should be limited only by the scope of the claims listed below.

I claim:

1. An accessory mount for mounting an accessory device to a firearm, the firearm including a longitudinal barrel, a frame having a transverse bore and a trigger guard, the accessory mount comprising the combination of:

a longitudinal rail adapted for removably securing the accessory device thereto;

structural members upwardly projecting from the respective sides of said rail and adapted to straddle the frame with said rail beneath the barrel and forwardly of the trigger guard, said structural members including respective bores situated for being transversely aligned with the bore in the frame when the accessory mount is applied to the firearm;

a pin configured for being received by said bores in said structural members and the bore in the frame when the accessory mount is applied to the firearm;

an appendage downwardly projecting from said rail in the vicinity of the rear end of said rail, said appendage including a threaded bore and a set screw threadedly engaging said threaded bore;

an elastomeric member adapted to be wedged between said appendage and the trigger guard when the accessory mount is applied to the firearm with said pin received by said bores in said structural members and the bore in the frame; and a rigid plate interfacing said elastomeric member and said set screw.

2. The accessory mount according to claim 1, wherein:

said elastomeric member is carried by said appendage.

3. The accessory mount according to claim 2, wherein:

said appendage includes a front wall having a rear surface engaging said elastomeric member when the accessory mount is applied to the firearm.

4. The accessory mount according to claim 3, wherein:

said appendage includes rearwardly extending lateral walls; and said elastomeric member is fitted between said lateral walls.

5. The accessory mount according to claim 1, including:

a spacer on said rail for engaging a lower surface of the frame of the firearm.

6. The accessory mount according to claim 5, wherein:

said spacer comprises a resilient pad.

7. The accessory mount according to claim 1, the firearm including a slide and a slide stop, wherein:

said pin is secured to the slide stop for pivotally securing the slide stop to the frame of the firearm.

8. The accessory mount according to claim 1, the firearm including a slide, wherein said pin includes a head and an annular protrusion spaced from said head;

and including a slide stop rotatably secured to said pin between said head and said protrusion.

9. The accessory mount according to claim 8, wherein:

said pin includes an annular groove spaced from said head; and said protrusion includes a ring retained by said groove and peripherally protruding therefrom.

10. An accessory mount for mounting an accessory device to a firearm, the firearm including a longitudinal barrel, a frame having a transverse bore and a trigger guard, the accessory mount comprising the combination of:

a longitudinal rail adapted for removably securing the accessory device thereto;

structural members upwardly projecting from the respective sides of said rail and adapted to straddle the frame with said rail beneath the barrel and forwardly of the trigger guard, said structural members including respective bores situated for being transversely aligned with the bore in the frame when the accessory mount is applied to the firearm;

a pin configured for being received by said bores in said structural members and the bore in the frame when the accessory mount is applied to the firearm;

an appendage downwardly projecting from said rail in the vicinity of the rear end of said rail, said appendage including a front wall depending from said rail;

a generally wedge shaped elastomeric member adapted to be wedged between said appendage and the trigger guard when the accessory mount is applied to the firearm with said pin received by said bores in said structural members and the bore in the frame, said generally wedge shaped elastomeric member including a base, said generally wedge shaped elastomeric member including a first wedging face and a second wedging face in contact engagement respectively with a rear surface of said front wall and a front surface of said trigger guard when said generally wedge shaped elastomeric member is wedged between said appendage and said trigger guard;

said appendage includes a threaded bore and a set screw threadedly engaging said threaded bore for cooperating with said base for urging said generally wedge shaped elastomeric member to be wedged between said appendage and said trigger guard; and a rigid plate on said base for interfacing with said set screw.

11. The accessory mount according to claim 10, wherein:

said generally wedge shaped member is carried by said appendage.

12. The accessory mount according to claim 10, wherein:

said appendage includes rearwardly extending lateral walls; and said elastomeric member is fitted between said lateral walls.

13. The accessory mount according to claim 10, including:

a spacer on said rail for engaging a lower surface of the frame of the firearm.

14. The accessory mount according to claim 13, wherein:

said spacer comprises a resilient pad.

15. The accessory mount according to claim 10, the firearm including a slide and a slide stop, wherein said pin is secured to the slide stop for pivotally securing the slide stop to the frame of the firearm.

16. The accessory mount according to claim 10, the firearm including a slide, wherein said pin includes a head and an annular protrusion spaced from said head;

and including a slide stop rotatably secured to said pin between said head and said protrusion.

17. The accessory mount according to claim 16, wherein:

said pin includes an annular groove spaced from said head; and said protrusion comprises a ring retained by said groove and peripherally protruding therefrom.

18. An accessory mount for mounting an accessory device to a firearm, the firearm including a longitudinal barrel, a frame having a transverse bore and a trigger guard, the accessory mount comprising the combination of:

a longitudinal rail adapted for removably securing the accessory device thereto:

structural members upwardly projecting from the respective sides of said rail and adapted to straddle the frame with said rail beneath the barrel and forwardly of the trigger guard, said structural members including respective bores situated for being transversely aligned with the bore in the frame when the accessory mount is applied to the firearm;

a pin configured for being received by said bores in said structural members and the bore in the frame when the accessory mount is applied to the firearm;

an appendage downwardly projecting from said rail in the vicinity of the rear end of said rail;

an elastomeric member adapted to be wedged between said appendage and the trigger guard when the accessory mount is applied to the firearm with said pin received by said bores in said structural members and the bore in the frame;

a rigid plate carried by said elastomeric member; and a threaded bore through said appendage and a set screw threadedly engaging said threaded bore and aligned for contacting said rigid plate to urge said elastomeric member to wedge between said appendage and said trigger guard.

19. An accessory mount for mounting an accessory device to a firearm, the firearm including a longitudinal barrel, a frame having a transverse bore and a trigger guard, the accessory mount comprising the combination of:

a longitudinal rail adapted for removably securing the accessory device thereto:

structural members upwardly projecting from the respective sides of said rail and adapted to straddle the frame with said rail beneath the barrel and forwardly of the trigger guard, said structural members including respective bores situated for being transversely aligned with the bore in the frame when the accessory mount is applied to the firearm;

a pin configured for being received by said bores in said structural members and the bore in the frame when the accessory mount is applied to the firearm;

an appendage downwardly projecting from said rail in the vicinity of the rear end of said rail and including a front wall depending from said rail;

an elastomeric member adapted to be wedged between said appendage and the trigger guard when the accessory mount is applied to the firearm with said pin received by said bores in said structural members and the bore in the frame, said elastomeric member including a base, said elastomeric member including a first wedging face and a second wedging face in contact engagement respectively with a rear surface of said front wall and a front surface of said trigger guard when said elastomeric member is wedged between said appendage and said trigger guard;

a rigid plate on said base of said elastomeric member; and said appendage includes a threaded bore and a set screw threadedly engaging said threaded bore for cooperating with said base for urging said elastomeric member to be wedged between said appendage and said trigger guard.

* * * * *